US006978097B2

(12) United States Patent
Ozawa et al.

(10) Patent No.: US 6,978,097 B2
(45) Date of Patent: Dec. 20, 2005

(54) IMAGE-FORMING APPARATUS

(75) Inventors: Toru Ozawa, Saitama (JP); Akihiro Ouchi, Saitama (JP); Satoshi Ogi, Saitama (JP); Hideki Matsumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 328 days.

(21) Appl. No.: 10/627,681

(22) Filed: Jul. 28, 2003

(65) Prior Publication Data

US 2004/0109713 A1 Jun. 10, 2004

(30) Foreign Application Priority Data

Dec. 10, 2002 (JP) ..... P2002-357659

(51) Int. Cl.[7] ..... G03G 15/00

(52) U.S. Cl. ..... 399/88; 399/107; 399/110; 399/124

(58) Field of Search ..... 399/75, 88, 107, 399/110, 111, 113, 124

(56) References Cited

U.S. PATENT DOCUMENTS 6,263,185 B1 * 7/2001 Kato et al. ..... 399/381
6,757,516 B2 * 6/2004 Miura ..... 399/401
6,792,230 B2 * 9/2004 Saito et al. ..... 399/111

FOREIGN PATENT DOCUMENTS

JP 6-156775 6/1994
JP 7-179234 7/1995

* cited by examiner

*Primary Examiner*—Hoan Tran
(74) *Attorney, Agent, or Firm*—Morgan, Lewis & Bockius LLP

(57) ABSTRACT

An image-forming apparatus including: an image-forming unit disposed so as to be detachably attached to an apparatus body; at least one sheet supply unit disposed at a lower portion of the apparatus body so as to be located below the image-forming unit for supplying a sheet, and including a sheet tray detachably attached to a body of the sheet supply unit; and a sheet carrying system including a sheet carrying path extending vertically so that the sheet supplied from the sheet supply unit is carried to an image-forming region of the image-forming unit and then ejected, wherein a spatial portion communicating with the openings at a top and bottom portions of the apparatus body and facing at least one part of the sheet carrying path is formed when the image-forming unit and the sheet tray of each sheet supply unit are detached from the apparatus body.

13 Claims, 14 Drawing Sheets

| SITUATION | INTERLOCKING |
|---|---|
| DETACHING PROCESS CARTRIDGE | DISABLED |
| DETACHING ANY ONE OF SHEET CASSETTES | DISABLED |
| ATTACHING ALL SHEET CASSETTES | ENABLED |

| SITUATION | INTERLOCKING |
|---|---|
| DETACHING PROCESS CARTRIDGE | DISABLED |
| ATTACHING ANY ONE OF SHEET CASSETTES | ENABLED |
| DETACHING ALL SHEET CASSETTES | DISABLED |

IMAGE-FORMING APPARATUS

CROSS REFERENCE OF RELATED APPLICATION

This application is based on and claims priority under 35 U.S.C. § 119 with respect to Japanese Patent Application No. 2002-357659 filed on Dec. 10, 2002, the entire content of which is incorporated herein by reference.

BACKGROUND OF THE INVENTION

1. Field of the Invention

The present invention relates to an image-forming apparatus such as a copying machine, a printer or a facsimile machine and particularly to improvement in an image-forming apparatus having an image-forming unit and at least one sheet supply unit provided in a body of the apparatus, in which a sheet is carried substantially vertically from the sheet supply unit to the image-forming unit and then ejected.

2. Description of the Related Art

An image-forming apparatus having an image-forming unit such as a process cartridge disposed in a body of the apparatus, and at least one sheet supply unit disposed below the image-forming unit so that a sheet is carried substantially vertically from the sheet supply unit to the image-forming unit and ejected after the formation of an image on the sheet by the image-formation unit has been already known in the related art.

In this type image-forming apparatus, there has been used a method in which a measure against jamming in the sheet carrying path (hereinafter also referred to as anti-jamming process) or the maintenance of the apparatus is performed through an open door which is provided on a side of the apparatus body for opening the sheet carrying path (e.g., see Document 1).

[Document 1]
JP-A-6-156775

[Document 2]
JP-A-7-179234

In this type image-forming apparatus, it is however difficult to place the apparatus body near the wall from a point of view of keeping a space for opening the open door. There is a technical problem that the space for installation of the image-forming apparatus becomes large unnecessarily.

To solve the technical problem, there has been known a technique in which: a sheet carrying path is provided on the user operation side of the apparatus body; a cover for attaching/detaching a sheet cassette of a sheet supply unit is provided on a front side of the apparatus body so as to be opened/closed freely; and an operation of attaching/detaching the sheet cassette and a measure against jamming, etc., in the sheet carrying path are carried out in the condition that the attachment/detachment cover is opened (e.g., see Document 2).

In this type technique, the sheet carrying path extending from the sheet supply unit, however, must be disposed on a front side of the apparatus body. Accordingly, when the sheet cassette is to be attached/detached, it is necessary to carry out an operation of attaching/detaching the sheet cassette after the attachment/detachment cover is once opened. There is a disadvantage that the operation of attaching/detaching the sheet cassette is troublesome. In addition, this type technique cannot at all be applied to an apparatus in which the sheet carrying path is disposed on a rear side of the apparatus body. There is also a disadvantage that the image-forming apparatus lacks general-purpose properties.

SUMMARY OF THE INVENTION

The invention is developed to solve the technical problems and an object of the invention is to provide an image-forming apparatus which can be installed in a required minimum installation space and in which an anti-jamming process or the maintenance of the apparatus can be performed easily for general purposes.

That is, as shown in FIG. 1, the invention provides an image-forming apparatus including: an image-forming unit 2 disposed so as to be detachably attached to an apparatus body 1; at least one sheet supply unit 3 disposed at a lower portion of the apparatus body 1 so as to be located below the image-forming unit 2 for supplying a sheet, and including a sheet tray 3*b* detachably attached to a body 3*a* of the sheet supply unit 3; and a sheet carrying system 7 including a sheet carrying path 6 extending substantially vertically in the apparatus body 1 so that the sheet supplied from the sheet supply unit 3 is carried to an image-forming region of the image-forming unit 2 and then ejected, wherein: the apparatus body 1 is provided with openings 1*a* and 1*b* formed at its top and bottom portions; and a spatial portion 8 communicating with the openings 1*a* and 1*b* at the top and bottom portions of the apparatus body 1 and facing at least one part of the sheet carrying path 6 is formed when the image-forming unit 2 and the sheet tray 3*b* of each sheet supply unit 3 are detached from the apparatus body 1.

This technical means is not limited to an embodiment in which the apparatus body 1 has only a box body 11 of standard specification. For example, the apparatus body 1 may have a box body 11 of standard specification, and an optional unit 12 disposed at a lower portion of the box body 11.

The image-forming unit 2 widely means a unit for forming an image. The image-forming unit 2 is not limited to a process cartridge using electrophotography. For example, an electrostatic recording type process cartridge or an ink jet type recording cartridge may be used as the image-forming unit 2.

The sheet supply unit 3 may be provided as standard equipment in the apparatus body 1 or may be used as an optional unit 12.

The image-forming unit 2 is attachable/detachable to/from the apparatus body 1 whereas the sheet tray 3*b* of each sheet supply unit 3 is attachable/detachable to/from the unit body 3*a*. The term "attachable/detachable" includes the case where the target (the image-forming unit 2 or the sheet tray 3*b*) is removed perfectly from the position of attachment, and the case where the target is not removed from the position of attachment but can be drawn out therefrom if the target is detachable from the position of attachment.

Incidentally, in the case where the sheet tray 3*b* is removed perfectly from the position of attachment, it is easy to insert a hand into the spatial portion 8 through the sheet tray insertion hole. Accordingly, it is a matter of course that an anti-jamming process or the maintenance of the sheet carrying system can be performed easily. When, for example, the maintenance of the sheet carrying system is performed by the hand inserted into the spatial portion 8 through the sheet tray insertion hole while eye observation is performed through the top opening 1*a*, working efficiency can be improved preferably because the direction of eye observation differs from the direction of insertion of the hand.

If the sheet carrying system 7 has a sheet carrying path 6 extending substantially vertically in the apparatus body 1 so that the sheet supplied from the sheet supply unit 3 is carried, the sheet carrying path 6 may be disposed in any suitable position such as a side of the apparatus body 1 or the back of the apparatus body 1.

The apparatus body 1 needs to have a top opening 1*a*, and a bottom opening 1*b*.

As a typical example, the top opening 1*a* serves also as an opening for an operation of attaching/detaching the image-forming unit 2 and is opened/closed by an opening/closing cover 13.

Although the top opening 1*a* generally serves also as an opening for an operation of attaching/detaching the image-forming unit 2, the top opening 1*a* is not limited thereto and may be provided separately from the opening for an operation of attaching/detaching the image-forming unit 2.

On the other hand, the bottom opening 1*b* is formed so that the sheet supply unit 3 provided as an optional unit 12 can be provided. The bottom opening 1*b* is provided preferably from the point of view of extending the apparatus systematically.

For example, in the image-forming apparatus of standard specification, it is a matter of course that the bottom opening 1*b* is formed in the box body 11 per se provided as the apparatus body 1. In the image-forming apparatus of extended specification in which the optional unit 12 is added, the bottom opening 1*b* needs to be formed in the unit body 3*a* per se of the sheet supply unit 3 provided as the optional unit 12 because the bottom portion of the apparatus body 1 is the bottom portion of the optional unit 12 per se.

The spatial portion 8 is a work space for performing a measure against jamming in the sheet carrying path 6 or the maintenance of the sheet feed device 14 of the sheet supply unit 3. The spatial portion 8 needs to communicate with the top and bottom openings 1*a* and 1*b* and face at least one part of the sheet carrying path 6.

The term "face at least one part of the sheet carrying path 6" includes the assumption that the portion does not face the sheet carrying path 6 when, for example, a feeder is set.

From the point of view of securing the spatial portion 8, the unit body 3*a* of each sheet supply unit 3 needs to have communication openings in upper and lower walls.

As a preferred embodiment concerning a mechanism between each sheet supply unit 3 as an optional unit 12 and the box body 11, the sheet supply unit 3 as the optional unit 12 may have a positioning mechanism by which the sheet supply unit 3 can be positioned relative to the box body 11 of standard specification.

Preferably, the sheet supply units 3 which are optional units 12 may be provided with a positioning mechanism by which the sheet supply units 3 can be disposed multistageously.

The term "positioning mechanism" used here maybe selected suitably. For example, the positioning mechanism may be positioning pins and positioning holes into which the position pins are fitted.

Generally, each sheet supply unit 3 further has a sheet feeding device 14 for feeding out a sheet.

In this case, each sheet supply unit 3 is preferably formed so that constituent elements of the sheet feeding device 14 are separately provided astride the unit body 3*a* and the sheet tray 3*b*. When the sheet feeding device 14 is separated, the sheet feeding performance and the handling property for attachment/detachment of the sheet tray 3*b* can be ensured easily.

As a preferred embodiment of the sheet feeding device 14, the unit body 3*a* side members of the sheet feeding device 14 may be disposed so that the postures thereof can be changed. When the postures are changed in this manner, the work space for performing the anti-jamming process in the spatial portion 8 can be kept larger.

The posture change of the unit body 3*a* side members may be selected suitably so that the members are rotated around a predetermined axis (predetermined axes) of rotation so as to be retracted or are folded at a bending point (bending points). The angle of the posture change may be selected suitably if the work space for performing the anti-jamming process, etc., in the spatial portion 8 can be secured.

As a typical embodiment of the invention constructed as an electrophotographic image-forming apparatus, the image-forming unit 2 is a process cartridge using electrophotography, and an exposure device 4 for writing an electrostatic latent image in an image carrier 2*a* of the process cartridge is fixed disposed in the apparatus body 1.

As a preferred embodiment from the point of view of security measures for the electrophotographic image-forming apparatus, there may be provided an imaging-forming apparatus including a power supply breaker 5 for interrupting the power supply to the exposure device 4 under the condition that the process cartridge (image-forming unit) 2 or at least one sheet tray 3*b* in the sheet supply units 3 is detached.

The power supply breaker 5 operates so that light emitted from the exposure device 4 is prevented from being leaked to the user through the top opening 1*a*, the bottom opening 1*b* and the insertion hole of the sheet tray 3*b*.

As a preferred embodiment from the point of view of security measures for the electrophotographic image-forming apparatus in which a Load While Run function (function for making printing possible even in the case where any one of the sheet trays 3*b* is removed) is ensured, the image-forming apparatus further includes: a power supply breaker 5 for interrupting the power supply to the exposure device 4 under the condition that the process cartridge (image-forming unit) 2 is detached; and a light shielding member 9 for blocking a view field connecting the sheet tray 3*b* insertion hole of at least one unit body 3*a* to the optical path of the exposure device 4 when the sheet tray 3*b* is detached from the unit body 3*a* of each sheet supply unit 3.

According to this embodiment, the light shielding member 9 avoids leaking of light at least through the sheet tray 3*b* insertion hole while the power supply breaker 5 avoids leaking of light through the top opening 1*a*.

Although the embodiment may be preferably formed so that the light shielding member 9 can also avoid leaking of light through the bottom opening 1*b*, the light shielding member 9 need not avoid leaking of light through the bottom opening 1*b*.

This is because the bottom opening 1*b* is blocked when the image-forming apparatus is usually installed. Furthermore, in an embodiment of the image-forming apparatus heavy in weight, it is inconceivable that the apparatus is inverted, for example, at the time of maintenance. Accordingly, in this type image-forming apparatus, it is inconceivable that light is leaked through the bottom opening 1*b*, so that there is little demand that leaking of light through the bottom opening 1*b* should be avoided by the light shielding member 9.

On the contrary, in the image-forming apparatus light in weight, the apparatus may be inverted, for example, at the time of maintenance, so that there is a strong demand that leaking of light through the bottom opening 1*b* should be avoided.

As a preferred embodiment in this case, the image-forming apparatus provided with multi-stage sheet supply units 3 further includes: a power supply breaker 5 for permitting the power supply to the exposure device 4 when at least one sheet tray 3*b* in the multi-stage sheet supply units 3 is attached, but interrupting the power supply to the exposure device 4 when the process cartridge (image-forming unit) 2 is detached or all the sheet trays 3*b* of the sheet supply units 3 are detached; and a light shielding member 9 for blocking a view field connecting the sheet tray 3*b* insertion hole of the unit body 3*a* to the optical path of the exposure device 4 when the sheet tray 3*b* is detached from the unit body 3*a* of any one of the sheet supply units 3.

According to this embodiment, the power supply breaker 5 avoids leaking of light through the top opening 1*a* and the bottom opening 1*b* while the light shielding member 9 avoids leaking of light through the sheet tray 3*b* insertion hole. Accordingly, light emitted from the exposure device 4 can be surely prevented from being leaked to the user while the Load While Run function can be ensured.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

The invention will be described below in detail on the basis of embodiments shown in the accompanying drawings.

Embodiment 1

Figure 1:
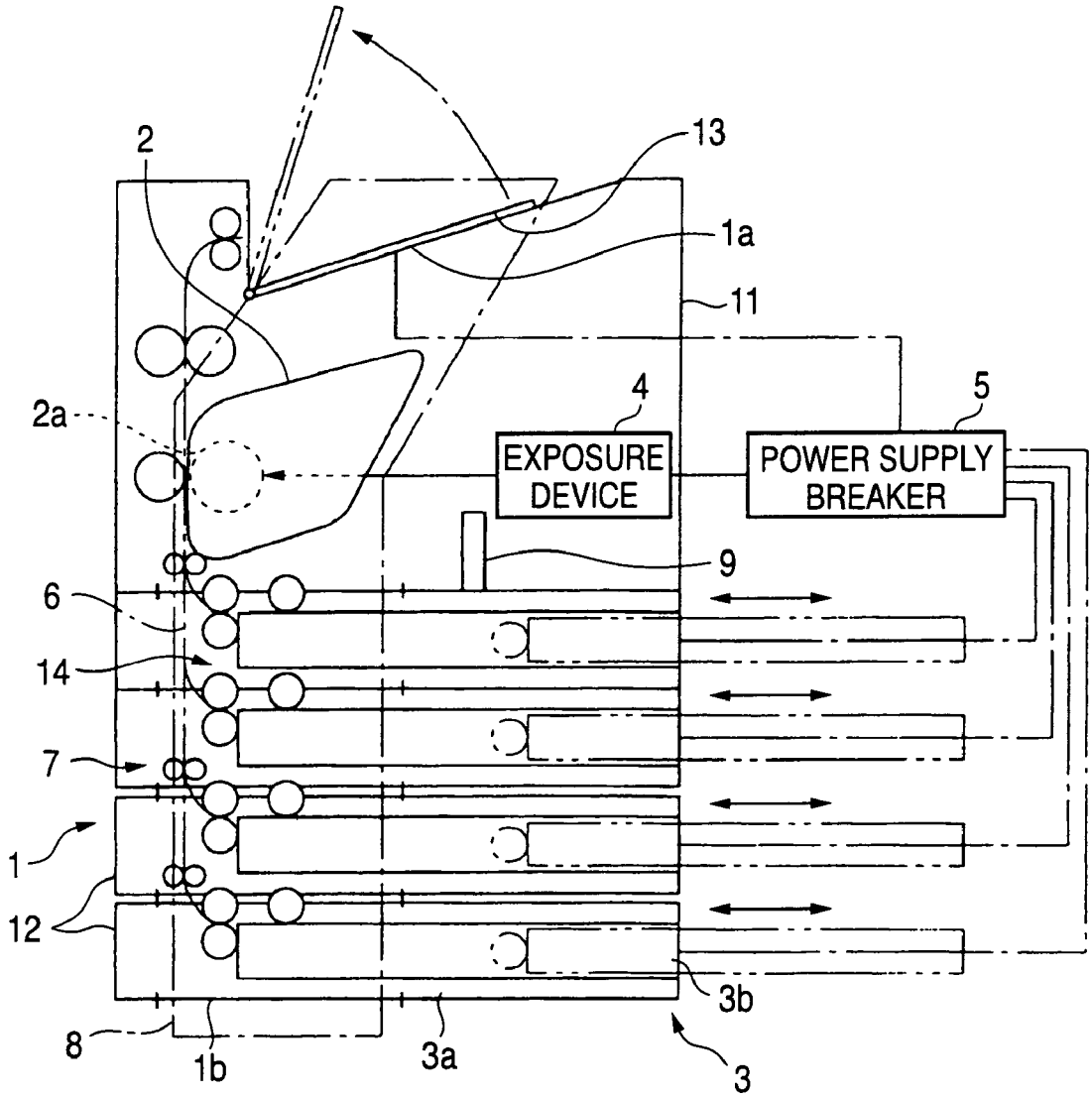
FIG. 1 is an explanatory view showing the outline of an image-forming apparatus according to the invention.
Figure 2:
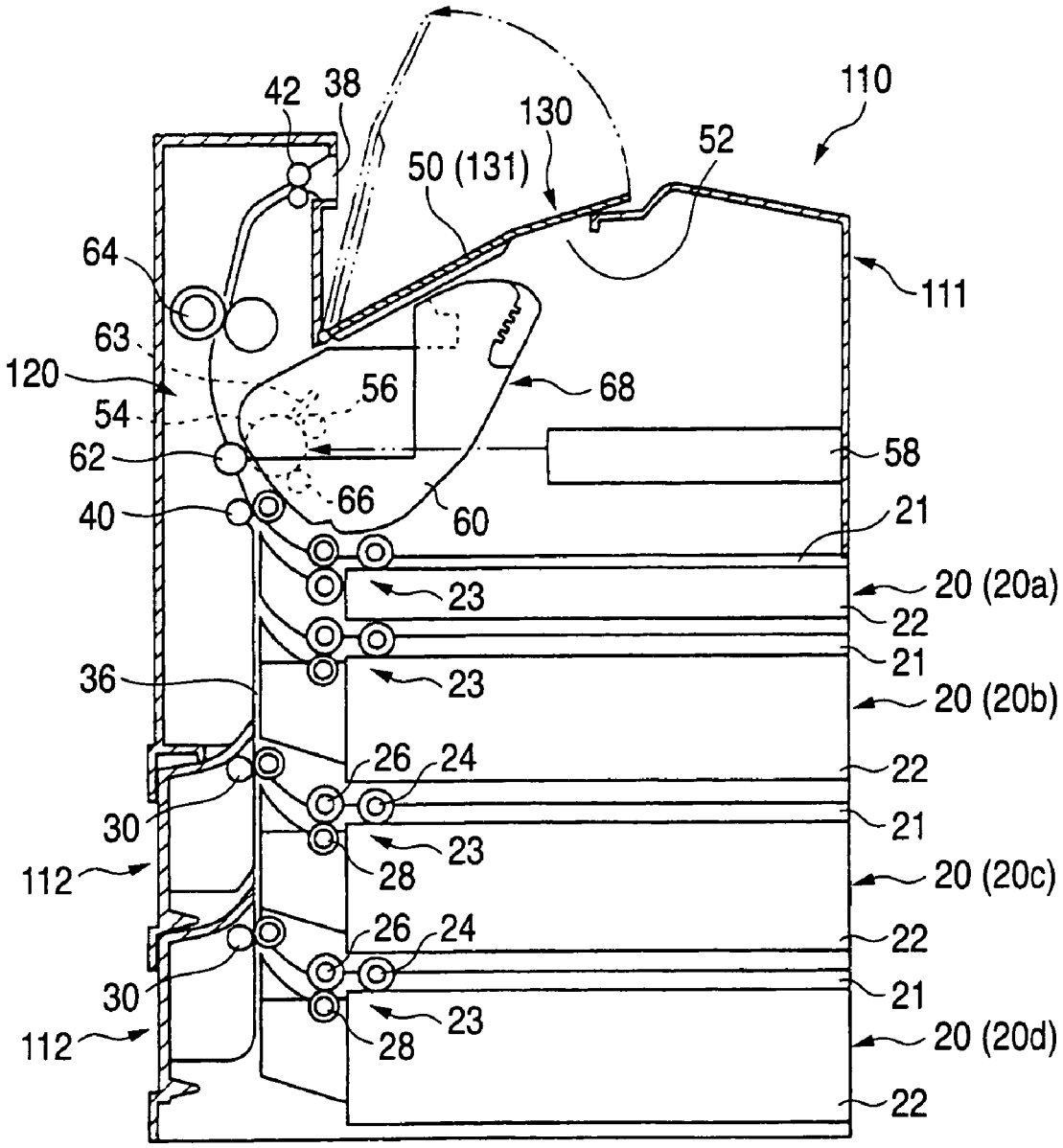
FIG. 2 is an explanatory view showing the overall configuration of the image-forming apparatus according to Embodiment 1 of the invention.
Figure 3:
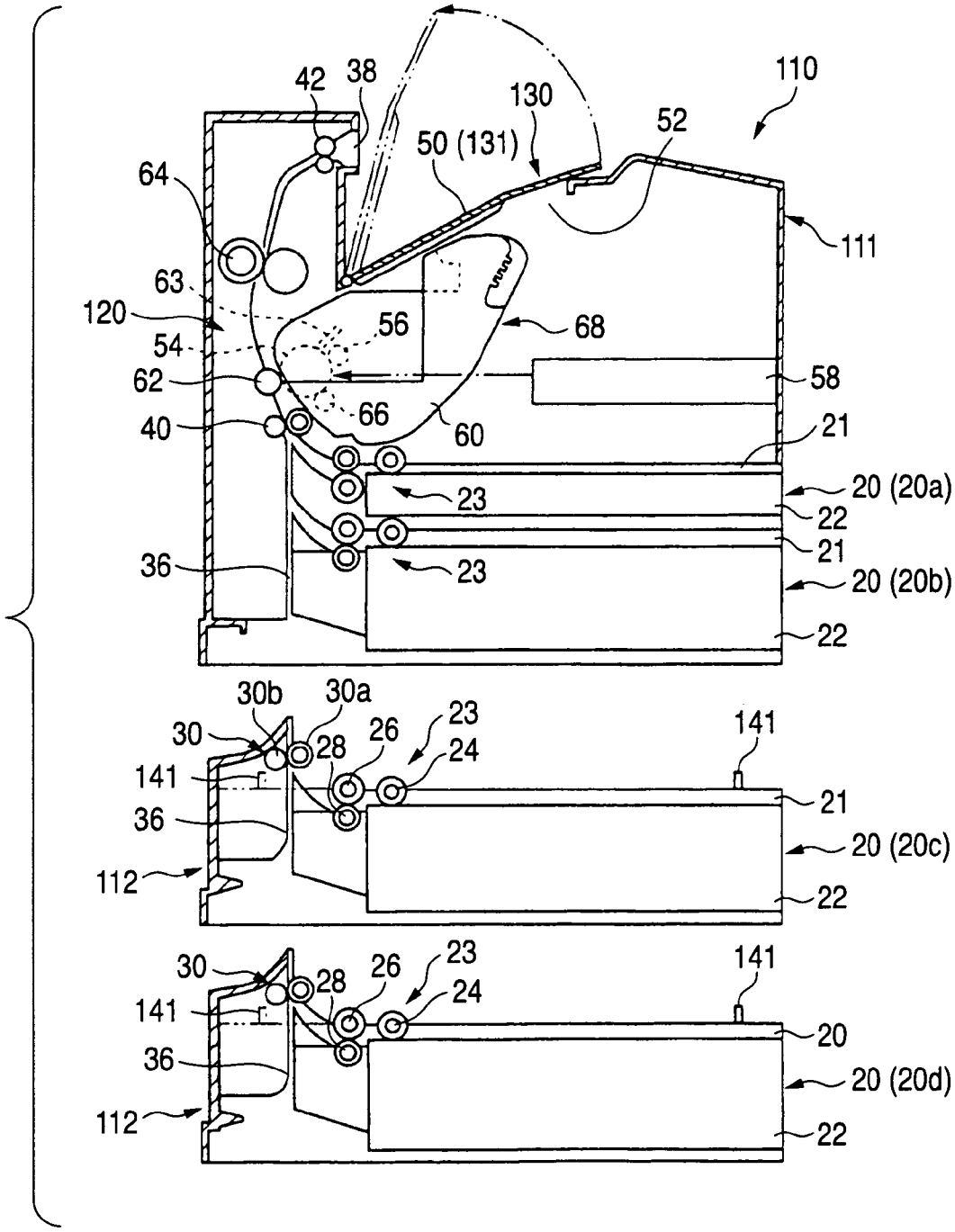
FIG. 3 is an explanatory view showing an example of configuration of an apparatus body used in Embodiment 1.

FIGS. 2 and 3 show Embodiment 1 of an image-forming apparatus to which the invention is applied.

In FIGS. 2 and 3, the image-forming apparatus has an apparatus body 110 forming an apparatus casing.

In this example, the apparatus body 110 includes a box body 111 as an apparatus casing of standard specification, and unit bodies 21 of two-stage sheet supply units 20 (specifically, 20*c* and 20*d*) as optional units 112 disposed in a lower portion of the box body 111.

In this embodiment, an image-forming portion 120 is mounted in the box body 111 of the apparatus body 110. A sheet ejection portion 130 for receiving ejected sheets is provided at the top portion of the box body 111. For example, two-stage sheet supply units 20 (specifically, 20*a* and 20*b*) which are units provided as standard equipment are disposed in the lower portion of the box body 111 so as to be below the image-forming portion 120.

A sheet carrying path 36 for carrying a sheet supplied from each of the sheet supply units 20 (20*a* to 20*d*) is provided in the apparatus body 110 (the box body 111 and the optional units 112). The sheet carrying path 36 extends to an ejection hole 38 of the box body 111 after going through the image-forming portion 120.

For example, the image-forming portion 120 uses electrophotography. The image-forming portion 120 has: a photoconductor drum 54 as an image carrier; a charger 56, for example, made of a charge roll for electrically evenly charging the photoconductor drum 54; an exposure device 58 for optically writing an electrostatic latent image on the photoconductor drum 54 electrically charged by the charger 56; a developer 60 using developing agents for visualizing the latent image formed on the photoconductor drum 54 by the exposure device 58; a transfer device 62, for example, made of a transfer roll for transferring the developing agent image formed by the developer 60 onto a sheet of paper; a cleaning device 63, for example, made of a blade for cleaning the developing agents remaining on the photoconductor drum 54; and a fixing device 64, for example, made of a pair of a heating roll and a pressuring roll by which the developing agent image transferred onto the sheet by the transfer device 62 is fixed on the sheet.

In this embodiment, the exposure device 58 is, for example, constituted by a scanning type laser exposure device. The exposure device 58 is disposed in parallel to the sheet supply units 20 (20*a* to 20*d*) and near the front surface of the box body 111. Light emitted from the exposure device 58 goes across the developer 60 so that the photoconductor drum 54 is exposed to the light.

The developer 60 has a developing roll 66 facing the photoconductor drum 54.

In this embodiment, a process cartridge 68 formed in such a manner that a plurality of electrophotographic devices are integrated with one another is used. In this example, the photoconductor drum 54, the charger 56, the developer 60 and the cleaning device 63 are integrated as the process cartridge 68.

The sheet ejection portion 130 has an inclined portion 131 inclined to the box body 111. A top opening 52 is formed in the inclined portion 131. The top opening 52 is opened/closed by an opening/closing cover 50.

The inclined portion 131 is inclined so as to be low at a portion corresponding to the ejection hole 38 but be gradually heightened frontward (rightward in FIG. 2). The opening/closing cover 50 is supported to the box body 111 so that the opening/closing cover 50 can rotate around the lower end of the inclined portion 131.

Particularly in this example, the process cartridge 68 is disposed right below the inclined portion 131 of the sheet ejection portion 130. The top opening 52 serves also as an opening for an operation of attaching/detaching the process cartridge 68. When the opening/closing cover 50 is opened, the process cartridge 68 is attached/detached through the top opening 52.

In this embodiment, the sheet carrying path 36 has a vertically carrying path extending substantially vertically on the rear side of the apparatus body 110. Registration rolls 40 are provided on the upstream side of the photoconductor drum 54 in the vertically carrying path. Ejection rolls 42 are provided near the ejection hole 38. Incidentally, the photoconductor drum 54, the transfer device (transfer roll) 62 and the fixing device 64 located so as to face the sheet carrying path 36 serve also as carrying members.

Accordingly, the sheet supplied from any one of the sheet supply units 20 is temporarily stopped by the registration rolls 40 in the sheet carrying path 36 and carried to an image transfer position of the process cartridge 68 at predetermined timing so that an image is transferred onto the sheet. Then, the sheet passes through the fixing device 64 and is ejected to the sheet ejection portion 130 by the ejection rolls 42.

The sheet supply units 20 (20*a* to 20*d* ) are basically identical in configuration. Of the sheet supply units 20*a* and 20*b* provided as standard equipment, the upper-stage sheet supply unit 20*a* has a sheet capacity selected to be smaller than that of the lower-stage sheet supply unit 20*b*.

Figure 4:
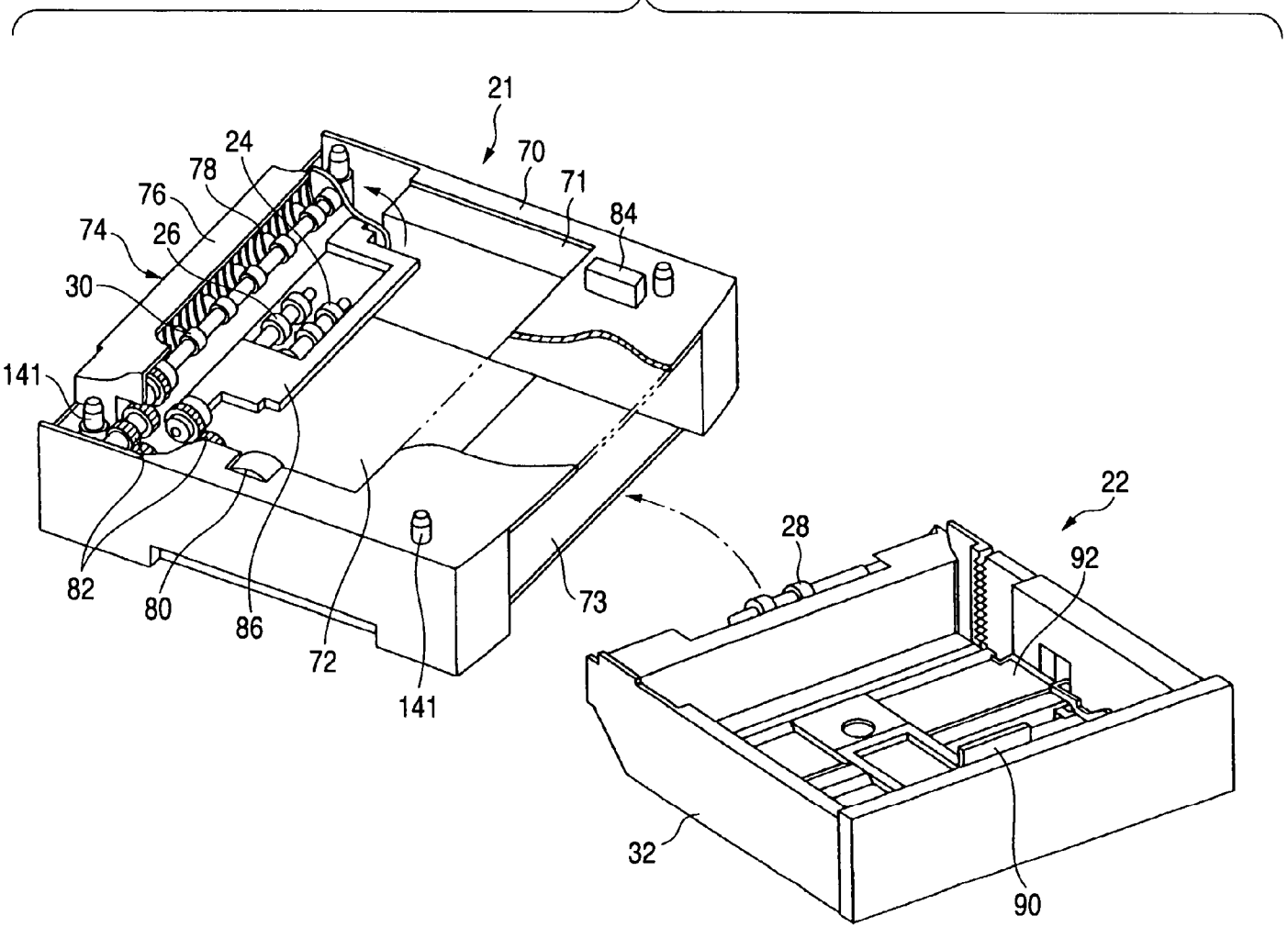
FIG. 4 is an explanatory view showing an example of configuration of a sheet supply unit used in Embodiment 1.

When each of the sheet supply units 20 (20*c* and 20*d* ) which are optional units 112 is taken as an example, as shown in FIGS. 2 and 4, the sheet supply unit 20 has a unit body 21, and a sheet cassette (sheet tray) 22 detachably attached to the unit body 21 and provided for receiving sheets.

The sheet cassette 22 is slidably attached to the unit body 21. In this example, the sheet cassette 22 is provided so as to be perfectly drawn out frontward (rightward in FIG. 2).

A feeder (sheet feed unit) 23 for feeding out a sheet from the sheet cassette 22 is provided on the rear side of the sheet supply unit 20. The feeder 23 has a nudger roll 24 for paying out sheets, a feed roll 26 provided on the sheet feed side of the nudger roll 24, and a retard roll 28 disposed to face the feed roll 26 for delivering sheets one by one.

A pair of carrying rolls 30 (30*a* and 30*b* ) are provided on the sheet feed side of each sheet supply unit 20 to the feeder 23. Incidentally, the pair of carrying rolls 30 are provided only in each of the sheet supply units 20 (20*c* and 20*d* ) provided as optional units 112.

More in detail, as shown in FIG. 4, each unit body 21 has a box-like unit body frame 70. Communication openings 71 and 72 are formed in upper and lower walls of the unit body frame 70. A cassette insertion hole 73 is formed in a front wall of the unit body frame 70. A protrusion 74 is provided at a top portion of the unit body frame 70 in the sheet carrying direction.

A support plate 86 capable of being erected is rotatably provided in the unit body frame 70. Usually, the support plate 86 is kept in horizontal posture to support the nudger roll 24 and the feed roll 26. On the other hand, carrying rolls 30 are provided in the protrusion 74.

Figure 5A:
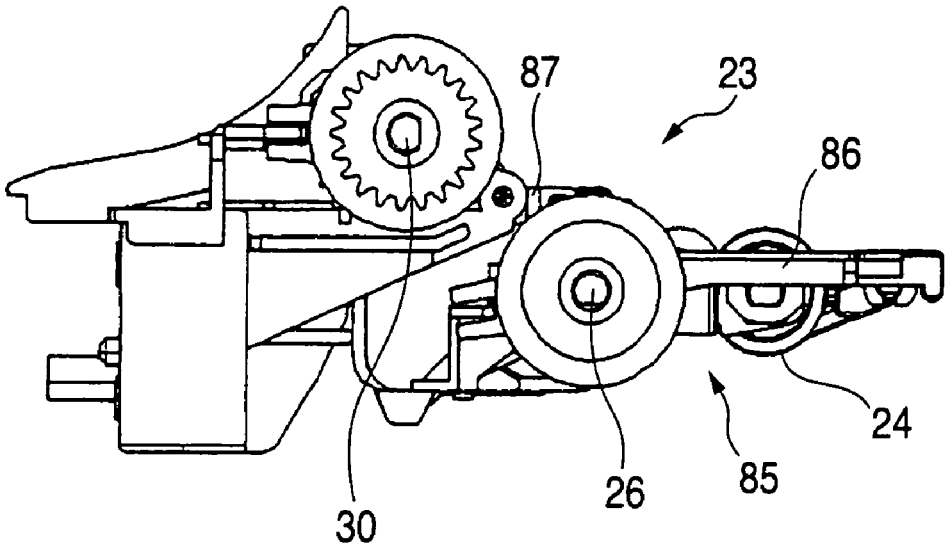
FIGS. 5A and 5B are explanatory views showing the behavior of a sub-unit portion of a feeder 23 in the sheet supply unit used in Embodiment 1.
Figure 5B:
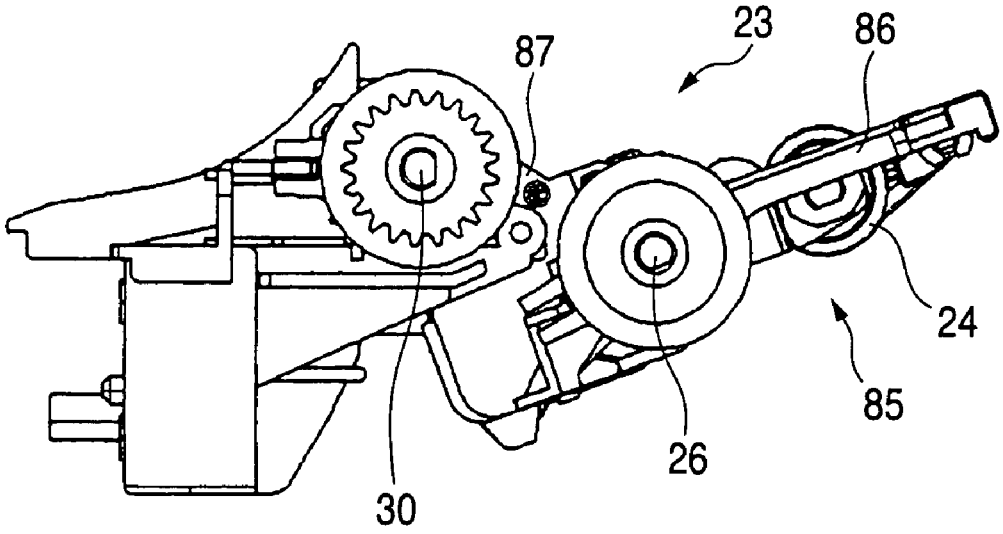
Figure 6:
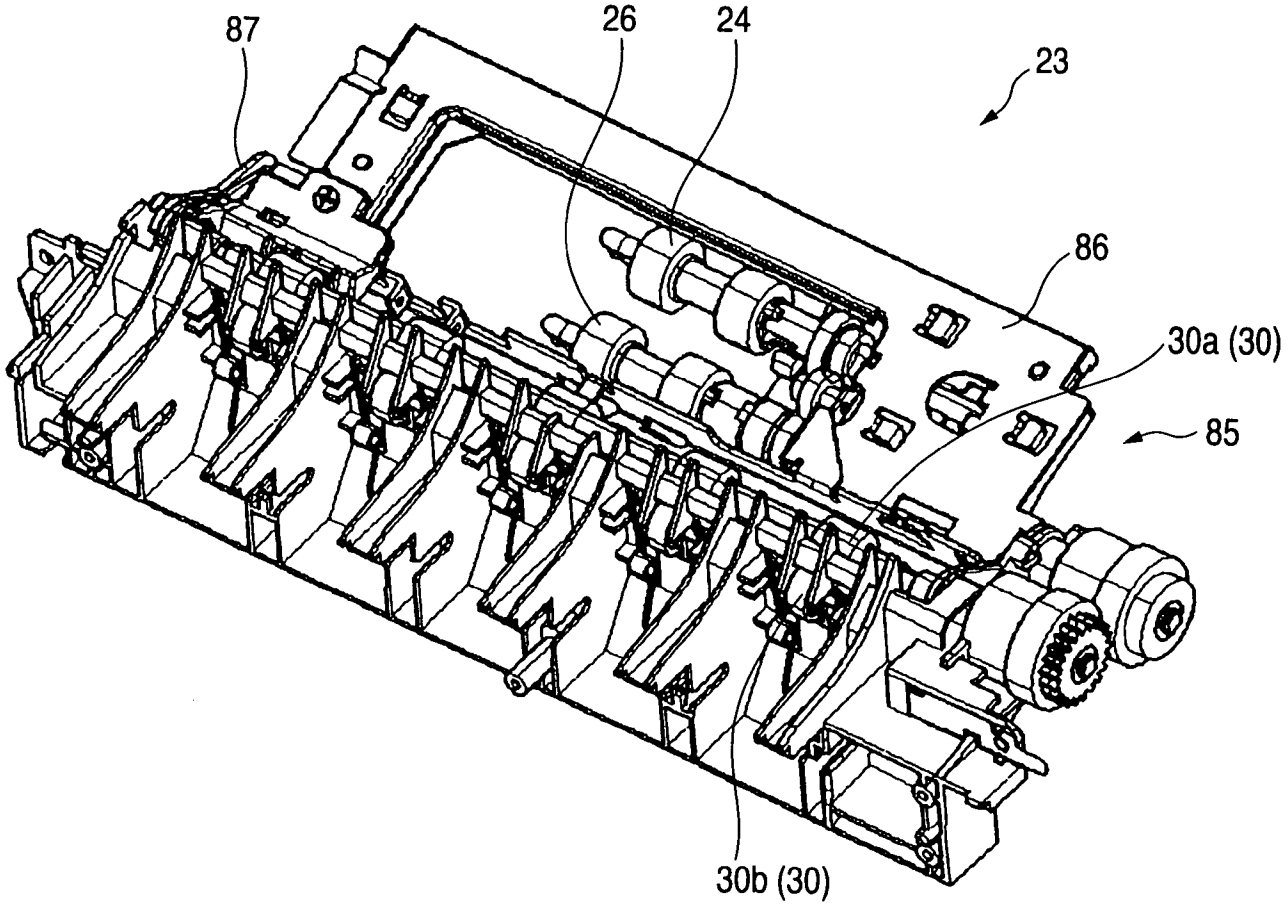
FIG. 6 is an explanatory perspective view showing an erected state of the sub-unit of the feeder 23.

More specifically, as shown in FIGS. 5A and 5B and FIG. 6, for example, the sub-unit 85, which has the nudger roll 24, the feed roll 26 and the support plate 86, rotates around the shaft of the feed roll 26 while the sub-unit 85 as a whole is pivotally supported by a rocking arm 87 with the carrying roll 30*a* used as a fulcrum of rotation.

Accordingly, in this embodiment, the feeder 23 is usually formed so that the nudger roll 24 and the feed roll 26 are kept in substantially horizontal posture as shown in FIG. 5A. If the sub-unit 85 is pushed up by hand so as to be erected as a whole as shown in FIGS. 5B and 6, the sub-unit 85 can be erected as a whole in oblique posture with the shaft of the carrying roll 30*a* as a fulcrum of rotation so that the sheet carrying path 36 can be opened.

As shown in FIG. 4, a protective cover 76 is provided above the carrying rolls 30.

The protective cover 76 covers the carrying rolls 30 from above. Accordingly, the carrying rolls 30 can be prevented from being damaged when the box body 111 which is the apparatus body 110 is piled on the sheet supply unit 20. In addition, an operating person can be kept safe.

A guide portion 78 is formed in the inside of the protective cover 76 so as to protrude like a rib. A sheet from the downstream side is guided and carried to the carrying rolls 30.

Incidentally, in this example, the protective cover 76 and the guide portion 78 are integrated with the unit body frame 70.

A drive motor 80 is disposed on an inner side of a side surface of the unit body frame 70. The drive motor 80 is connected to the nudger roll 24, the feed roll 26 and the carrying rolls 30 through a gear train 82 so that these rolls 24, 26 and 30 can be driven by the drive motor 80. The drive motor 80 drives these rolls 24, 26 and 30 on the basis of an instruction given from, a control device not shown.

In this manner, the drive system of the sheet supply unit 20 is provided in the inside of the unit body frame 70. Because the drive transmission system is not separated, the drive transmission to the rolls 24, 26 and 30 can be performed smoothly.

Incidentally, the reference numeral 84 designates a connector for supplying electric power to the drive motor 80 and transmitting control signals from the apparatus body 110 to the sheet supply unit 20 (see FIG. 2).

As shown in FIGS. 2 and 4, each sheet cassette 22 has a cassette frame 32. The retard roll 28 is supported on the deep side of the cassette frame 32 in the direction of insertion of the sheet cassette 22.

An end guide 90 is provided in the inside of the cassette frame 32 so as to be movable frontward/rearward. The end guide 90 limits the rear end position of sheets in the sheet cassette 22.

A sheet loading plate 92 is disposed at the bottom portion of the cassette frame 32 so as to be rotatable. The sheet loading plate 92 moves up/down according to the number of remaining sheets. The sheet loading plate 92 is provided with a control mechanism for always keeping the carrying position of a sheet located as the uppermost one of sheets laminated on the sheet loading plate 92.

Incidentally, the shape of the cassette frame 32 may be fixed in advance or an auxiliary frame slidable relative to a fixed frame may be provided so that the length of the cassette frame 32 can be changed according to extension of the auxiliary frame.

In this embodiment, as shown in FIGS. 3 and 4, each of the sheet supply units 20 (20*c* and 20*d* ) which are optional units 112 has a plurality of positioning pins 141 in the upper wall of the unit body 21. Positioning holes not shown are provided in portions of the lower wall of the unit body 21 corresponding to the positioning pins 141.

Incidentally, the unit body 21 of the sheet supply unit 20*b* as standard equipment is revealed directly from the bottom portion of the box body 111. Positioning holes are formed in the lower wall of the unit body 21 of the sheet supply unit 20*b* in the same manner as described above.

Hence, according to this embodiment, the sheet supply units 20 (20*c* and 20*d* ) which are optional units 112 are disposed multistageously while positioned to each other by a positioning mechanism having the positioning pins 141 and the positioning holes.

On the other hand, the sheet supply unit 20*c* is disposed so as to be added to the box body 111 while positioned to the box body 111 by engaging the positioning pins 141 with the positioning holes in the bottom portion of the box body 111.

In this embodiment, an interlocking mechanism 200 is provided so as to be operated by opening/closing of the top opening 52 and attachment/detachment of the process cartridge 68.

Figure 7A:
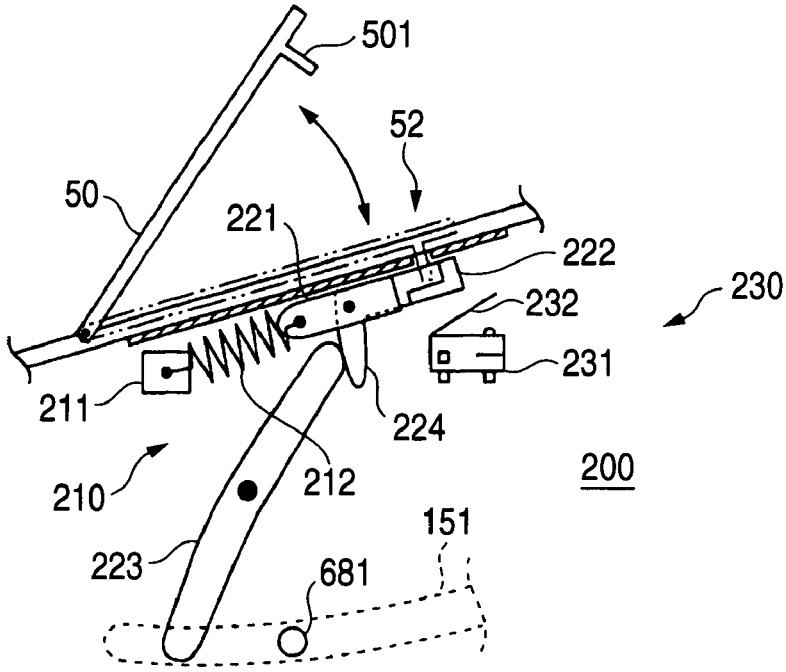
FIGS. 7A and 7B are explanatory views showing an example of an interlocking mechanism for detecting opening/closing at a top opening of the apparatus body and attachment/detachment of a process cartridge, FIG. 7A showing a state in which the process cartridge is detached at the time of opening at the top opening, FIG. 7B showing a state in which the process cartridge is attached at the time of closing at the top opening.
Figure 7B:
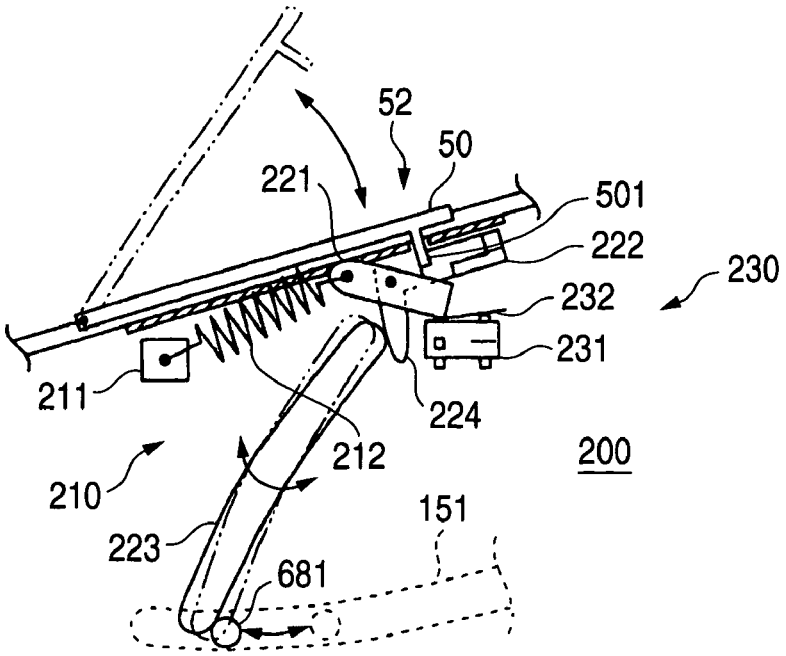

For example, the interlocking mechanism 200 is formed as shown in FIGS. 7A and 7B.

In FIGS. 7A and 7B, the opening/closing cover 50 operates to open/close the top opening 52. An operating protrusion 501 is formed at a free end of the opening/closing cover 50 so as to protrude from the free end of the opening/closing cover 50.

A guide protrusion 681 is formed on the process cartridge 68 so as to protrude from the process cartridge 68. A cartridge guide not shown is provided in the apparatus body 110 (box body 111). A guide slot 151 is formed in the cartridge guide so that the guide protrusion 681 is slidably fitted into the guide slot 151.

On this occasion, the guide protrusion 681 is engaged with the guide slot 151 so that the process cartridge 68 to be attached is guided to a predetermined position in the apparatus body 110 (box body 111).

The interlocking mechanism 200 has: a linking mechanism 210 which can be engaged with the operating protrusion 501 provided on the opening/closing cover 50 and the guide protrusion 681 of the process cartridge 68; and a switching mechanism 230 which is turned on/off while interlocked with the operation of the linking mechanism 210.

The linking mechanism 210 has a fixing member 211, a spring 212, and first to third link arms 221 to 223.

The fixing member 211 is provided for fixing one end of the spring 212 to the apparatus body 110. The first link arm 221 has one end connected to the other end of the spring 212 and is provided so as to rotate around the center of rotation provided at the near center of the first link arm 221.

The second link arm 222 is provided so as to be movable. The first link arm 221 is pivotally supported by part of the second link arm 222. A locking protrusive piece 224 is formed so as to protrude from part of the second link arm 222.

The third link arm 223 is pivotally supported to the apparatus body 110 while the third link arm 223 is pivoted on its near center. The third link arm 223 has one end disposed so as to face the guide slot 151, and the other end engaged with the locking protrusive piece 224 of the second link arm 222.

The switching mechanism 230 has a switch body 231, and a switch lever 232. For example, the switching mechanism 230 is provided so that a contact point is closed when the switch lever 232 is pushed down, but the contact point is opened after the pushing of the switch lever 232 is stopped.

In the interlocking mechanism 200, when, for example, the process cartridge 68 is not attached to the predetermined position in the apparatus body 110 so that the guide protrusion 681 in the guide slot 151 does not push the end portion of the third link arm 223 to the terminal side as shown in: FIG. 7A, the second link arm 222 is urged to move toward the fixing member 211 by the spring 212 through the first link arm 221.

On this occasion, the operating protrusion 501 and the first link arm 221 of the opening/closing cover 50 are kept in a non-contact state even in the case where the opening/closing cover 50 is closed.

Accordingly, the switch lever 232 of the switching mechanism 230 cannot be pushed down.

When, for example, the process cartridge 68 is attached to the predetermined position in the apparatus body 110 as shown in FIG. 7B, the guide protrusion 681 in the guide slot 151 moves the end portion of the third link arm 223 to the terminal side. As a result, the third link arm 223 rotates from the chain double-dashed line position to the solid line portion. With the rotation of the third link arm 223, the second link arm 222 moves right in FIG. 7B.

Then, the first link arm 221 is moved right in FIG. 7B following the second link arm 222 against the urging force of the spring 212, so that the first link arm 221 is positioned so as to be able to abut on the operating protrusion 501 of the opening/closing cover 50.

In this condition, when the opening/closing cover 50 is closed, the operating protrusion 501 abuts on the first link arm 221 to push the first link arm 221 to the switch lever 232 side. Then, the first link arm 221 rotates around the fulcrum of the second link arm 222 to push down the switch lever 232 to thereby close the contact point of the switching mechanism 230.

In this manner, the interlocking mechanism 200 is formed so that the contact point of the switching mechanism 230 is closed under the condition that the process cartridge 68 is attached to the predetermined position in the apparatus body 110 and the opening/closing cover 50 is closed, but the contact point of the switching mechanism 230 is opened under the other conditions.

In this embodiment, an interlocking mechanism 250 is provided so as to be operated according to attachment/detachment of the sheet cassette 22 to/from any one of the sheet supply units 20 (20*a* to 20*d* ).

Figure 8A:
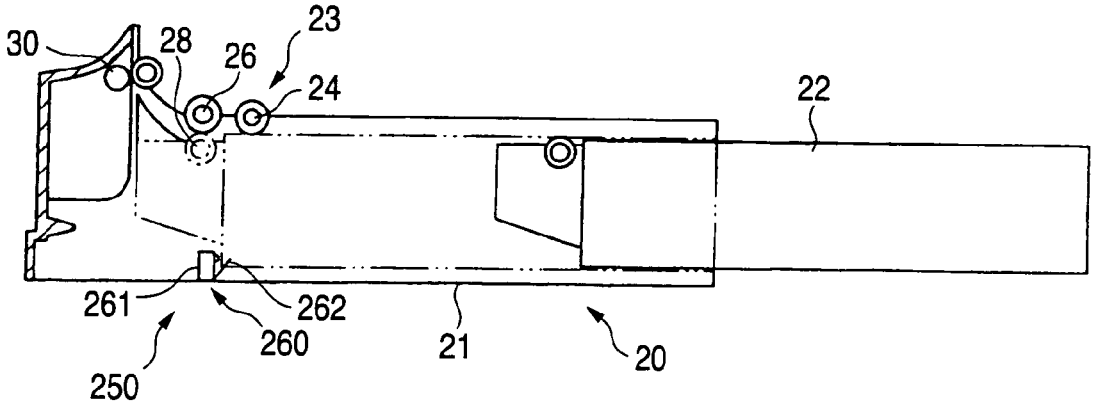
FIGS. 8A and 8B are explanatory views showing an example of the interlocking mechanism for detecting attachment/detachment of a sheet cassette to/from the sheet supply unit, FIG. 8A showing a state in which the sheet cassette is detached, FIG. 8B showing a state in which the sheet cassette is attached.
Figure 8B:
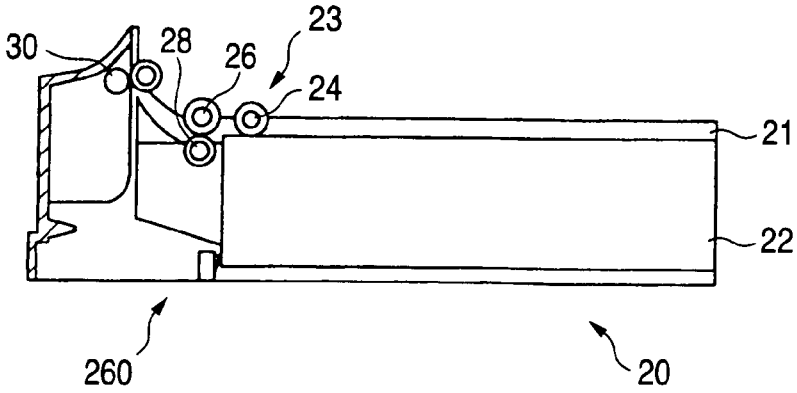

For example, the interlocking mechanism 250 has a switching mechanism 260 (having a switch body 261, and a switch lever 262) fixedly provided on the unit body 21 side as shown in FIGS. 8A and 8B. When the sheet cassette 22 is detached from the predetermined position, the front end portion of the sheet cassette 22 and the switching mechanism 260 are kept in a non-contact state as shown in FIG. 8A. On the other hand, when the sheet cassette 22 is attached to the predetermined position, the switch lever 262 of the switching mechanism 260 is brought into contact with part of the front end portion of the sheet cassette 22 to thereby close the contact point of the switching mechanism 260, as shown in FIG. 8B.

Accordingly, when the sheet cassette 22 is detached from the predetermined position in any one of the sheet supply units 20, the interlocking mechanism 250 operates to keep the contact point of the switching mechanism 260 of the sheet supply unit 20 open.

Figures 9A, 9B:
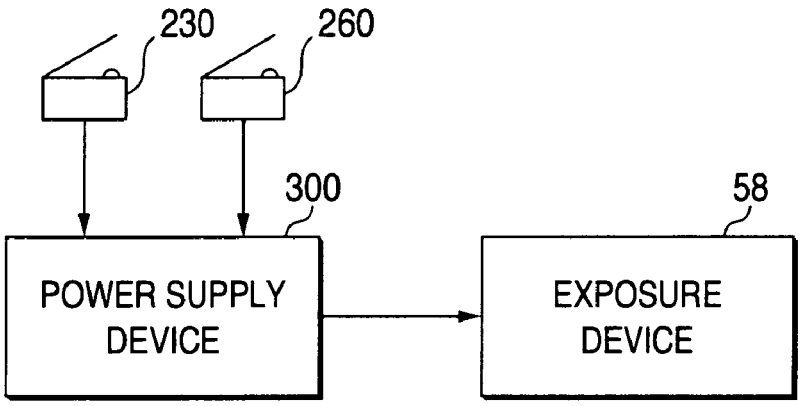
FIG. 9A is an explanatory view showing an example of a power supply control system of an exposure device due to the interlocking mechanism.
FIG. 9B is an explanatory view showing an operating state of the interlocking mechanism.

FIG. 9A shows a power supply control system of an exposure device in the image-forming apparatus according to this embodiment.

In FIG. 9A, the reference numeral 58 designates an exposure device; and 300, a power supply device for supplying electric power to the exposure device 58. The power supply device 300 fetches signals from the switching mechanisms 230 and 260 of the interlocking mechanisms 200 and 250 (provided in each sheet supply unit 20).

When either of the contact points of the switching mechanisms 230 and 260 is kept open, the power supply device 300 interrupts the power supply.

Accordingly, in this embodiment, when the process cartridge 68 is detached, the power supply to the exposure device 58 is interrupted by the action of the interlocking mechanism 200 regardless of the opening/closing operation of the opening/closing cover 50 as shown in FIG. 9B.

When the sheet cassette 22 in any one of the sheet supply units 20 is detached, the power supply to the exposure device 58 is interrupted by the action of the interlocking mechanism 250.

For this reason, the power supply to the exposure device 58 is ensured by the action of the interlocking mechanisms 200 and 250 when all the sheet cassettes 22 in the sheet supply units 20 are attached in the condition that the process cartridge 68 is attached.

An example of the anti-jamming or maintenance process in the image-forming apparatus according to this embodiment will be described below.

Figure 10:
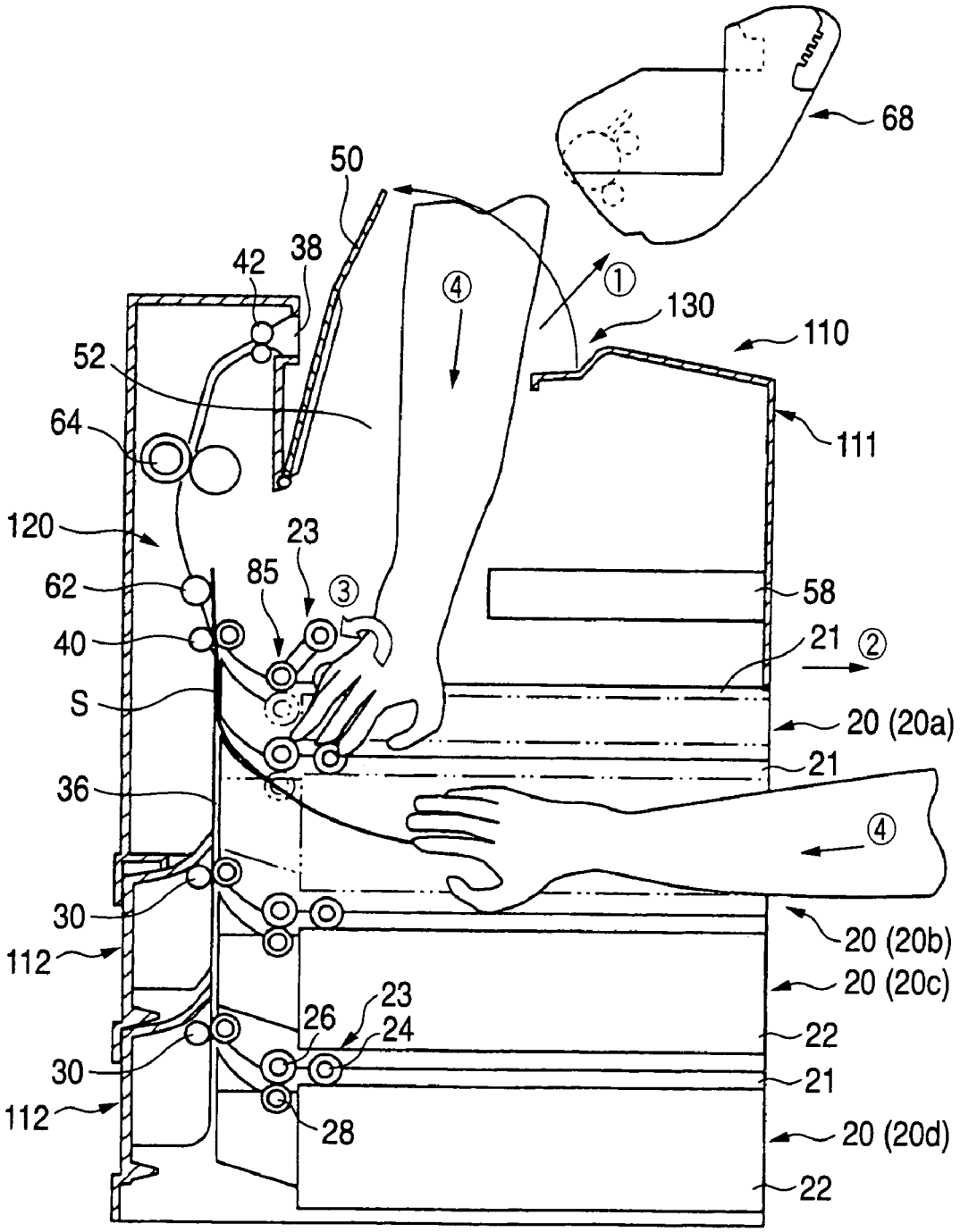
FIG. 10 is an explanatory view showing an example of operation of an anti-jamming or maintenance process of the image-forming apparatus according to Embodiment 1.

Description will be made here while the case where jamming occurs, for example, in a process of sending out a sheet S from the sheet supply unit 20 (20*b* ) as shown in FIG. 10 is taken as an example.

In this case, the following operations (1) to (4) may be carried out as a procedure of the anti-jamming process.

(1) The opening/closing cover 50 is opened and the process cartridge 68 is removed.

(2) The sheet cassette 22 of the sheet supply unit 20 (20*b* ) as a subject of the anti-jamming process and the sheet cassette 22 of a sheet supply unit 20 (e.g., 20*a* ) located above the sheet supply unit 20 (20*b* ) are drawn out.

(3) Of the feeder 23, the sub-unit 85 including the nudger roll 24 and the feed roll 26 is rotated and retracted in oblique posture if necessary (see FIGS. 5A, 5B and 6).

(4) The sheet S causing the jamming is removed by the hand inserted through the top opening 52 or removed from the cassette insertion hole 73 (see FIG. 4) after removal of the sheet cassette 22.

When the operations (1) and (2) are carried out in the anti-jamming process, a work space for the anti-jamming process is secured in the periphery of the sheet S causing the jamming in the apparatus body 110.

The operation (3) is carried out when the feeder 23 portion of the uppermost-stage sheet supply unit 20*a* is a barrier to the anti-jamming process by the hand inserted through the top opening 52 in the case where the sheet carrying path 36 needs to be opened. If not necessary, the operation (3) can be dispensed with.

For the operation (4), which of the top opening 52 and the cassette insertion hole 73 of the sheet cassette 22 is used for the anti-jamming process can be selected by the user's free will.

For example, the process for maintenance (e.g., exchange of the nudger roll 24 or the feed roll 26) of the feeder 23 in the second-uppermost-stage sheet supply unit 20*b* can be carried out by the same procedure as described above.

Incidentally, when the maintenance process is carried out while the feeder 23 portion is watched, operating efficiency can be improved. It is therefore preferable that the maintenance process is carried out while the feeder 23 portion is checked through the top opening 52, for example, by the hand inserted into the cassette insertion hole 73 of the sheet cassette 22.

In this case, operating efficiency is preferably improved because the direction of eye observation differs from the direction of insertion of the hand.

Incidentally, it is a matter of course that the maintenance process may be carried out while the feeder 23 portion is watched through the top opening 52 and, at the same time, the hand is inserted into the top opening 52.

When, for example, a subject of the anti-jamming process or the maintenance process is a position near the lowermost-stage sheet supply unit 20*d*, it is necessary to remove the process cartridge 68 and remove all the sheet cassettes 22 of the sheet supply units 20.

In this case, the user can carry out the anti-jamming process or the maintenance process by his or her hand inserted into the spatial portion through the top opening 52 because the spatial portion for making the top opening 52 of the apparatus body 110 communicate with the bottom opening (e.g., the communication opening formed in the lower wall of the sheet supply unit 20*d* ) is secured.

In the anti-jamming process or the maintenance process, the top opening 52 or the cassette insertion hole 73 is opened. In this embodiment, however, as shown in FIG. 9B, the power supply to the exposure device 58 is interrupted by the action of the interlocking mechanisms 200 and 250 under the condition that the top opening 52 or the cassette insertion hole 73 is opened.

For this reason, there is no fear that light emitted from the exposure device 58 may be leaked through the top opening 52 or the cassette insertion hole 73.

Embodiment 2

Figure 11:
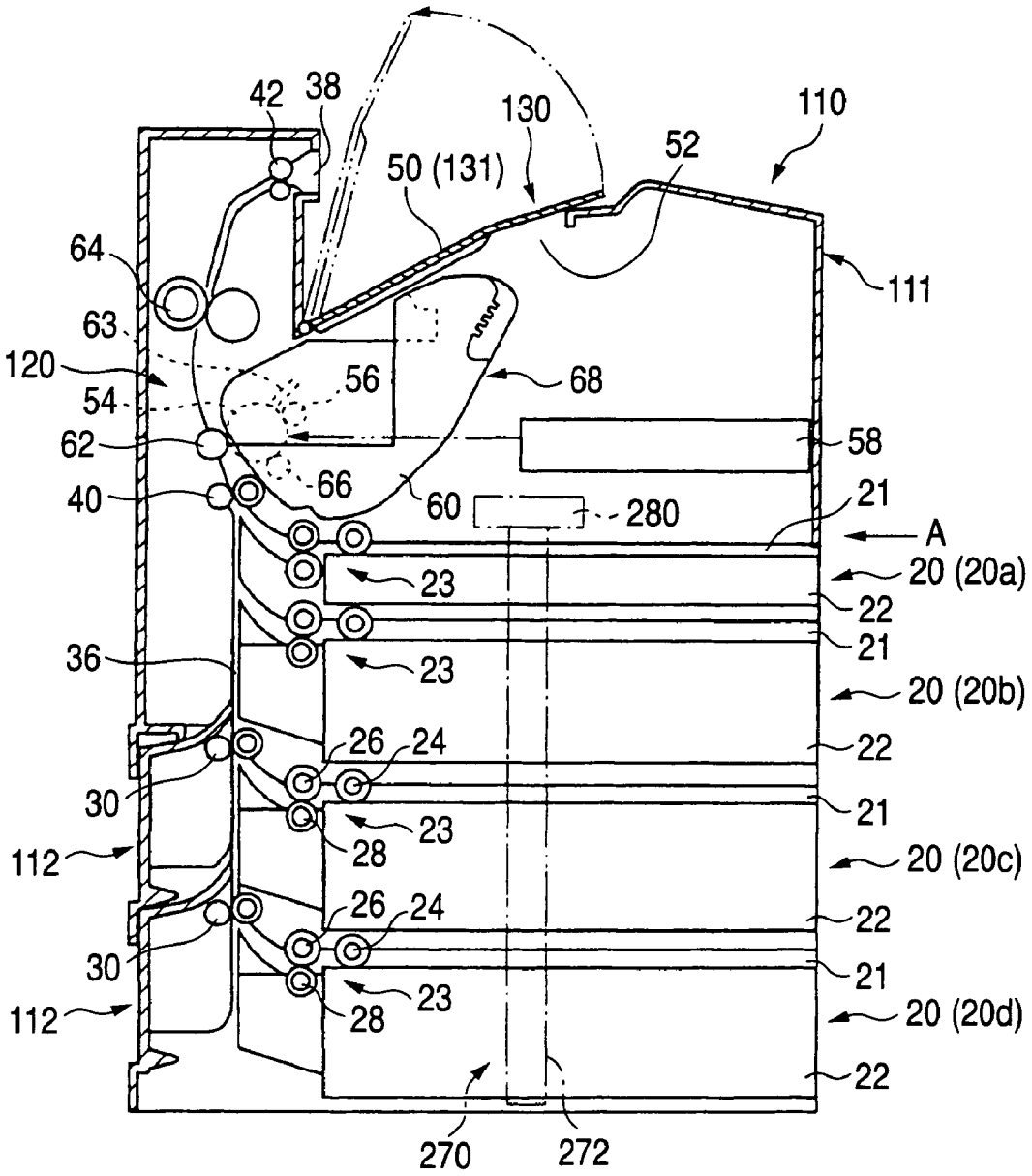
FIG. 11 is an explanatory view showing the overall configuration of the image-forming apparatus according to Embodiment 2 of the invention.

FIG. 11 is an explanatory view showing important part of the image-forming apparatus according to Embodiment 2 of the invention.

In FIG. 11, the basic configuration of the image-forming apparatus is substantially the same as that according to Embodiment 1 except an interlocking mechanism 270 for detecting attachment/detachment of the sheet cassettes 22 of the sheet supply units 20. Incidentally, constituent parts the same as those in Embodiment 1 are denoted by the same reference numerals as those in Embodiment 1, so that detailed description of the parts will be omitted here.

Figure 12A:
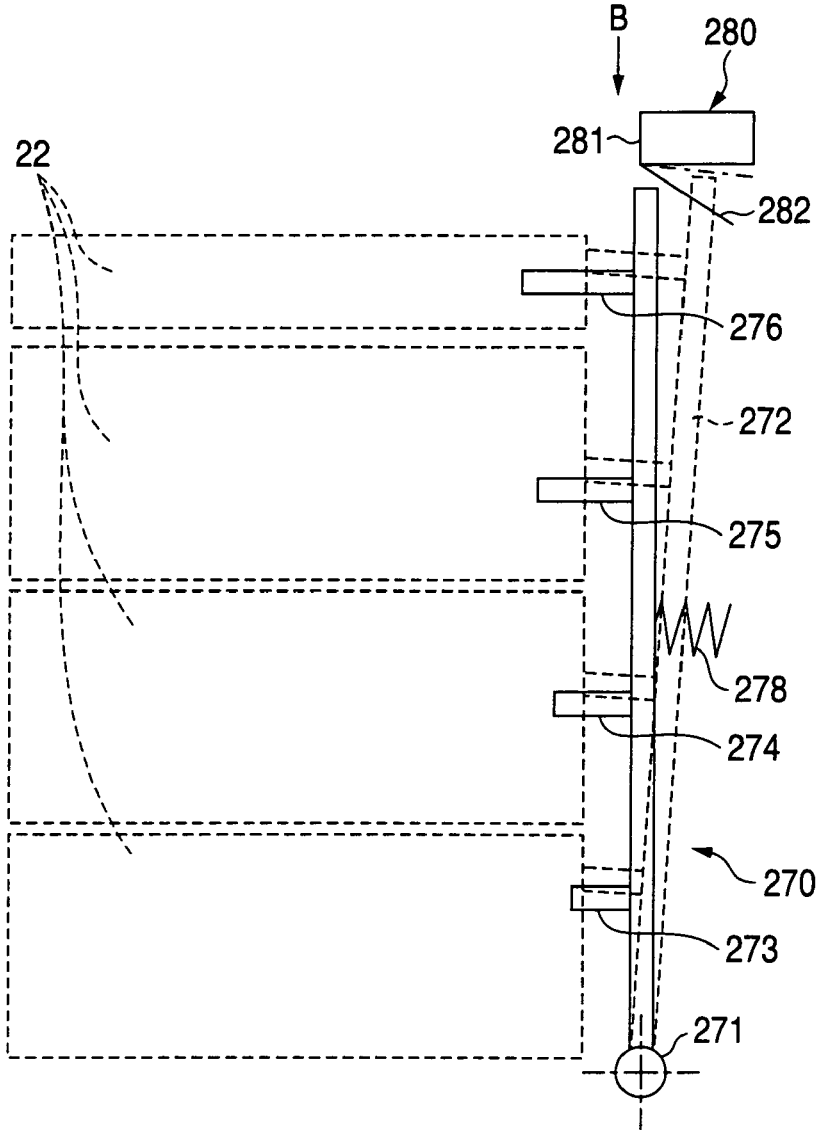
FIG. 12A is a view from the arrow A in FIG. 11.
Figure 12B:
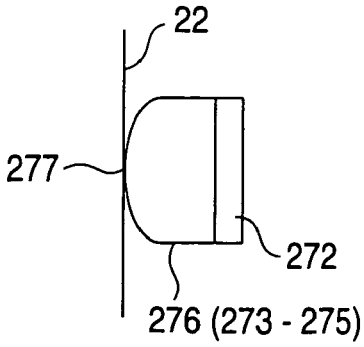
FIG. 12B is a view from the arrow B in FIG. 12A.

That is, as shown in FIGS. 11, 12A and 12B, the interlocking mechanism 270 used in this embodiment includes: a rocking lever 272 disposed on a side of the apparatus body 110 astride the positions of the sheet cassettes 22 of the sheet supply units 20 (20*a* to 20*d* ) so as to rotate around a fulcrum 271 of rotation at a lower end; engagement pieces 273 to 276 provided opposite to the sheet cassettes 22 respectively so as to protrude from the rocking lever 272; an urging spring 278 for urging the rocking lever 272 toward the sheet cassette 22 side; and a switching mechanism 280 (having a switch body 281, and a switch lever 282) disposed in a position corresponding to the rocking free end of the rocking lever 272. The interlocking mechanism 270 operates so that the contact point of the switching mechanism 280 is opened when the rocking lever 272 is urged to be located in nearly vertical posture.

Incidentally, the engagement pieces 273 to 276 are arranged in order of length so that the lowermost engagement piece 273 is shortest. A front end portion of each of the engagement pieces 273 to 276 is formed as a circular arc-shaped abutting portion 277 in order to reduce contact resistance between the engagement piece and the sheet cassette 22.

Accordingly, in the interlocking mechanism 270, when the sheet cassette 22 in any one of the sheet supply units 20 (20*a* to 20*d* ) is attached, corresponding one of the engagement pieces 273 to 276 of the rocking lever 272 abuts on the wall surface of the sheet cassette 22. Accordingly, as represented by the broken line in FIG. 12A, the rocking lever 272 is kept in oblique posture inclined to the nearly vertical posture, so that the rocking lever 272 is pressed against the switching mechanism 280 to thereby close the contact point of the switching mechanism 280.

On the other hand, when all the sheet cassettes 22 of the sheet supply units 20 are detached, the engagement pieces 273 to 276 of the rocking lever 272 do not abut on the wall surfaces of the sheet cassettes 22 at all. Accordingly, as represented by the solid line in FIG. 12A, the rocking lever 272 is moved to the position of nearly vertical posture by the urging force of the urging spring 278 so that the rocking lever 272 is disconnected from the switching mechanism 280 to thereby open the contact point of the switching mechanism 280.

Figures 13A, 13B:
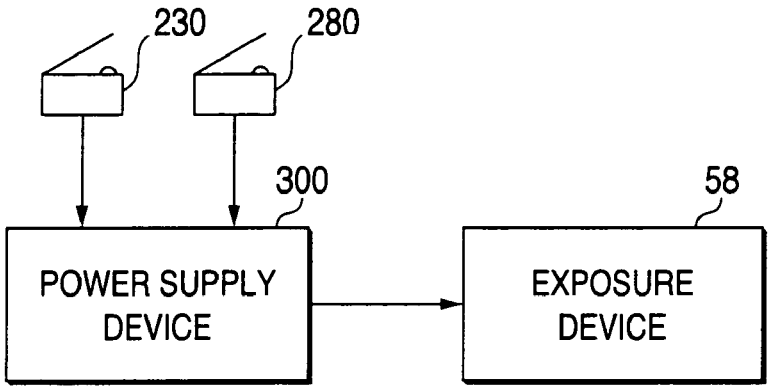
FIG. 13A is an explanatory view showing an example of the power supply control system of the exposure device due to the interlocking mechanism used in Embodiment 2.
FIG. 13B is an explanatory view showing an operating state of the interlocking mechanism.

FIG. 13A shows a power supply control system an exposure device in the image-forming apparatus according to this embodiment.

In FIG. 13A, the reference numeral 58 designates an exposure device; and 300, a power supply device for supplying electric power to the exposure device 58. The power supply device 300 fetches signals from the switching mechanisms 230 and 280 of the interlocking mechanisms 200 and 270.

In this case, the power supply device 300 is provided so that the power supply is interrupted in the same manner as in Embodiment 1 when either of the contact points of the switching mechanisms 230 and 280 is kept open.

Accordingly, in this embodiment, as shown in FIG. 13B, when the process cartridge 68 is detached, the power supply to the exposure device 58 is interrupted by the action of the interlocking mechanism 200 regardless of the opening/closing operation of the opening/closing cover 50.

When the sheet cassette 22 in any one of the sheet supply units 20 is attached, the power supply to the exposure device 58 is ensured by the action of the interlocking mechanism 270.

For this reason, the power supply to the exposure device 58 can be ensured to continue the printing operation even in the case where any sheet cassette 22 is removed, for example, according to the request to supply sheets.

Accordingly, if any one of the sheet supply units 20 can be used, the image-forming apparatus according to this embodiment copes with a Load While Run function effectively when the Load While Run function is requested as a function for making the printing operation possible.

Incidentally, when all the sheet cassettes 22 of the sheet supply units 20 are detached, the power supply to the exposure device 58 is interrupted by the action of the interlocking mechanism 270.

Figure 14:
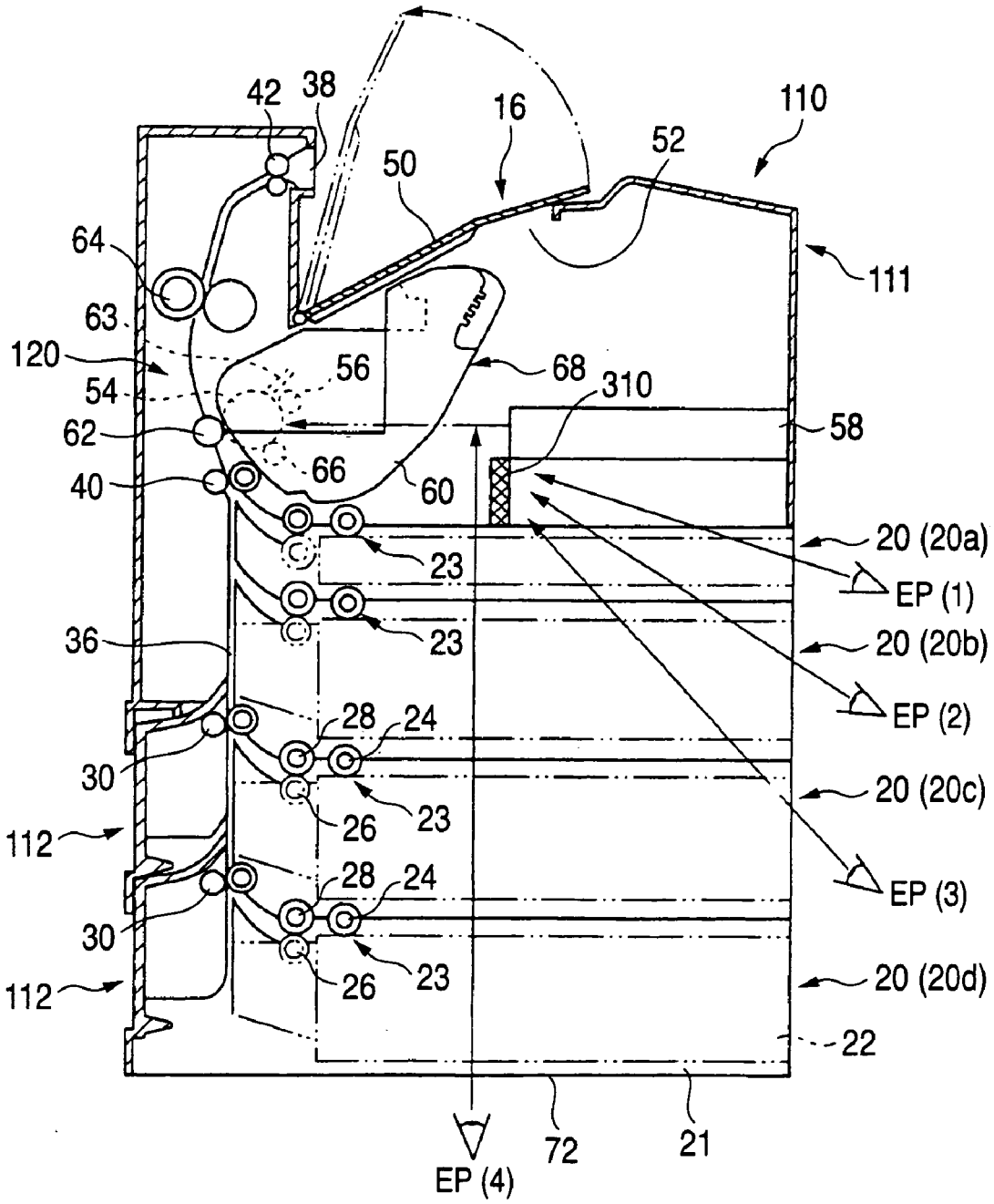
FIG. 14 is an explanatory view showing the action of a light shielding plate used in Embodiment 2.

In this embodiment, because the printing operation can be made if any one of the sheet supply units 20 can be used, the exposure operation of the exposure device 58 can be continued even in the case where any sheet cassette 22 in the sheet supply units 20 (20*a* to 20*d* ) is removed as shown in FIG. 14.

In this case, the cassette insertion hole 73 (see FIG. 4) after removal of the sheet cassette 22 is opened. This is undesirable from the point of view of security measures because there is fear that light emitted from the exposure device 58 may be leaked through the cassette insertion hole 73.

In this embodiment, therefore, a method of disposing a light shielding plate 310 in the apparatus body 110 (box body 111) is employed so that light emitted from the exposure device 58 is prevented from being leaked through the cassette insertion hole 73 after removal of the sheet cassette 22.

For example, the light shielding plate 310 maybe disposed in a position where a view field (from each of eye points EP (1) to EP(3) in FIG. 14) connecting the optical path of the exposure device 58 to the cassette insertion hole 73 of each of the sheet supply units 20 can be blocked. Incidentally, the view field (from the view point EP(4) in FIG. 14) through the bottom opening (equivalent to the communication opening 72 (see FIG. 4) of the sheet supply unit 20*d* ) can be ignored because the power supply to the exposure device 58 is interrupted by the action of the interlocking mechanism 270.

As described above, in accordance with the invention, the image-forming unit and the sheet trays of the sheet supply units are formed so as to be able to be attached/detached to/from the apparatus body so that the spatial portion for making the top potion of the apparatus body communicate with the bottom portion of the apparatus body is secured when the image-forming unit or any one of the sheet trays of the sheet supply units is detached from the apparatus body. Accordingly, even in the case where an opening/closing mechanism such as an open door is not provided on a side of the apparatus body, the user's hand can be inserted into the sheet carrying path or a neighbor of the sheet feeding device through the spatial portion from the top opening of the apparatus body or the sheet tray insertion hole.

For this reason, the apparatus per se can be installed near the wall, so that the anti-jamming process or the maintenance of the sheet carrying system can be carried out easily while the space for installation of the apparatus is minimized.

In an embodiment in which an opening/closing mechanism such as an open door is provided on a side of the apparatus body, application of the invention can contribute to reduction in cost and size of the apparatus though there was fear that increase in cost and size of the apparatus might be caused by rigidization of the apparatus body or addition of a reinforcing member because the presence of the open portion made the apparatus body fragile as a whole.

In an embodiment of the invention, a large spatial portion is secured in the apparatus body. For example, in an electrophotographic image-forming apparatus using an exposure device such as a laser scanner, there is fear that light emitted from the exposure device may be leaked from the top opening or the sheet tray insertion hole through the spatial portion.

In the invention, however, a power supply breaker for interrupting the power supply to the exposure device according to necessity and a light shielding member for blocking leaked light are disposed so that leaking light from the exposure device to the user can be avoided easily.

What is claimed is:

1. An image-forming apparatus comprising:

an image-forming unit disposed so as to be detachably attached to an apparatus body;

at least one sheet supply unit disposed at a lower portion of the apparatus body so as to be located below the image-forming unit for supplying a sheet, and including a sheet tray detachably attached to a body of the sheet supply unit; and a sheet carrying system including a sheet carrying path extending substantially vertically in the apparatus body so that the sheet supplied from the sheet supply unit is carried to an image-forming region of the image-forming unit and then ejected, wherein the apparatus body is provided with openings formed at its top and bottom portions; and a spatial portion communicating with the openings at the top and bottom portions of the apparatus body and facing at least one part of the sheet carrying path is formed when the image-forming unit and the sheet tray of each sheet supply unit are detached from the apparatus body.

2. An image-forming apparatus according to claim 1, wherein the apparatus body has only a box body of standard specification.

3. An image-forming apparatus according to claim 1, wherein the apparatus body has a box body of standard specification, and at least one unit body of the sheet supply unit as an optional unit disposed at a lower portion of the box body.

4. An image-forming apparatus according to claim 3, wherein the sheet supply unit as an optional unit has a positioning mechanism by which the sheet supply unit can be positioned relative to the box body of standard specification.

5. An image-forming apparatus according to claim 3, wherein the sheet supply unit as an optional unit has a positioning mechanism by which a plurality of sheet supply units can be disposed multistageously.

6. An image-forming apparatus according to claim 1, wherein the top opening of the apparatus body serves also as an opening for an operation of attaching/detaching the image-forming unit and is opened/closed by an opening/closing cover.

7. An image-forming apparatus according to claim 1, wherein the unit body of the sheet supply unit has communication openings at its upper and lower walls.

8. An image-forming apparatus according to claim 1, wherein the sheet supply unit has separate constituent elements of a sheet feed device extending both to the unit body and to the sheet tray.

9. An image-forming apparatus according to claim 8, wherein unit body-side elements of the sheet feed device are disposed so that postures of the unit body-side elements can be changed.

10. An image-forming apparatus according to claim 1, further comprising an exposure device disposed so as to be fixed to the apparatus body, wherein:

the image-forming unit is a process cartridge using electrophotography; and the exposure device is provided for writing an electrostatic latent image in an image carrier of the process cartridge.

11. An image-forming apparatus according to claim 10, further comprising a power supply breaker for breaking power supply to the exposure device under the condition that either the process cartridge or the sheet tray of at least one sheet supply unit is detached.

12. An image-forming apparatus according to claim 10, further comprising:

a power supply breaker for breaking power supply to the exposure device under the condition that the process cartridge is detached; and a light shielding member for interrupting a view field connecting a sheet tray insertion hole of each unit body at least to an optical path of the exposure device when the sheet tray is detached from the unit body of each sheet supply unit.

13. An image-forming apparatus according to claim 10, provided with multi-stage sheet supply units and further comprising:

a power supply breaker for allowing power supply to the exposure device when at least one of the sheet trays of the multi-stage sheet supply units is attached, but breaking power supply to the exposure device when the process cartridge is detached or all the sheet trays of the sheet supply units are detached; and a light shielding member for interrupting a view field connecting a sheet tray insertion hole of each unit body to an optical path of the exposure device when the sheet tray is detached from the unit body of each sheet supply unit.

* * * * *